United States Patent [19]

de la Pena

[11] 4,252,455

[45] Feb. 24, 1981

[54] SHAVING BRUSH ATTACHMENT

[76] Inventor: Abelardo de la Pena, 1551 N. Fries Ave., Wilmington, Calif. 90744

[21] Appl. No.: 47,147

[22] Filed: Jun. 11, 1979

[51] Int. Cl.[3] ..... A46B 11/02; B65D 83/14

[52] U.S. Cl. ..... 401/190; 222/402.13; 222/523; 401/144; 401/288; 401/289

[58] Field of Search ..... 401/190, 144, 170, 191, 401/272, 282, 286, 287, 288, 289; 222/402.13, 523

[56] References Cited

U.S. PATENT DOCUMENTS

| | | | |
|---|---|---|---|
| 299,144 | 5/1884 | Huntbatch | 401/288 |
| 2,764,772 | 10/1956 | Staskowski | 401/190 |
| 2,806,638 | 9/1957 | Ziherl | 222/402.13 |
| 3,149,761 | 9/1964 | Harris | 222/402.13 |
| 3,305,144 | 2/1967 | Beres | 401/190 |
| 3,434,633 | 3/1969 | Green | 222/402.13 |
| 3,685,913 | 8/1972 | Pass | 401/190 |
| 3,887,115 | 6/1975 | Patterson | 222/402.13 |

*Primary Examiner*—Clyde I. Coughenour
*Attorney, Agent, or Firm*—Abelardo de la Pena

[57] ABSTRACT

A shaving brush attachable on a replaceable aerosol can of shaving cream, the brush attachment including a spout extension, that fits on the can spout, so as to carry the discharged shaving cream directly into the brush bristle head.

2 Claims, 3 Drawing Figures

12
11
23
13
22
10
17
25
20
24
26
A
18
19
24
16
21
15
14

24
16
11
10

23
36
10
38
34
35
33
32
31
17a
B
28
20
30
37
27
29

SHAVING BRUSH ATTACHMENT

This invention relates generally to shaving brushes.

It is well known, that in conventional shaving practice, a shaving cream cannister and a separate brush are used, so as to lather the beard prior to using a razor. This necessitates the separate handling of two different parts for lathering up.

A principal object of the present invention is to provide a shaving brush which attaches directly upon a shaving cream cannister, so as to require handling of only one part for lathering up, and wherein the shaving cream is discharged from the can directly to the brush bristles, so as to eliminate the need of the hand contacting the lather.

Another object is to provide a shaving brush attachment, which saves time when a person is usually in a hurry, such as in the morning when readying for going to work.

Other objects are to provide a shaving brush attachment, which is simple in design, inexpensive to manufacture, rugged in construction, easy to use and efficient in operation.

Figure 1:
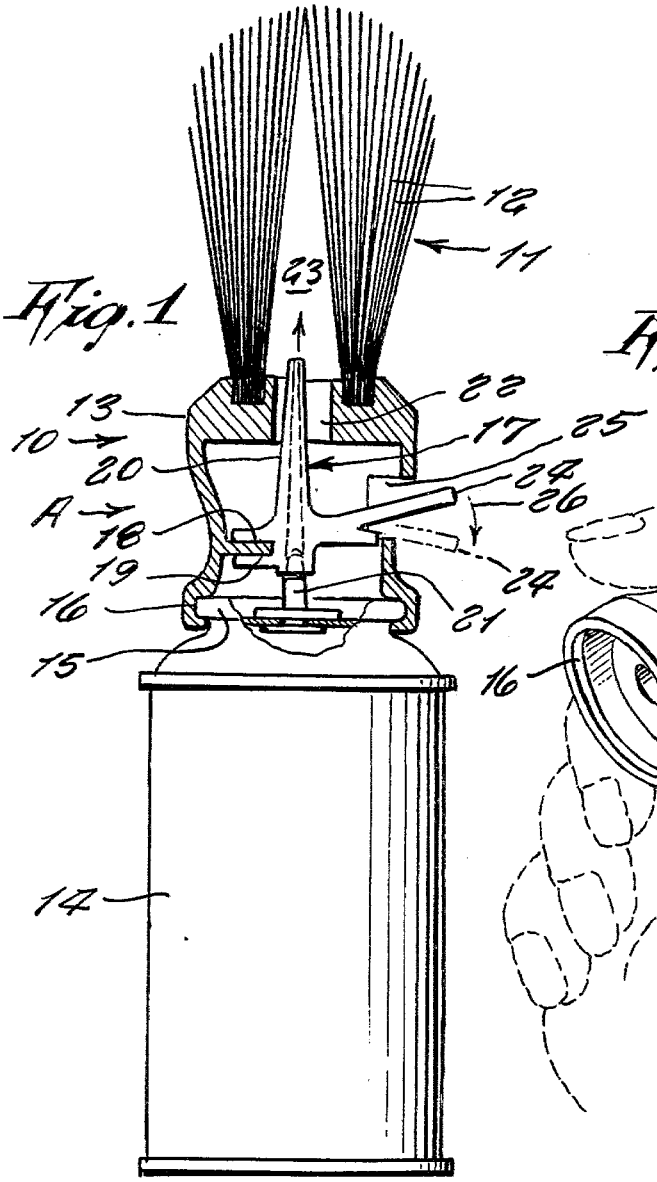
Figure 2:
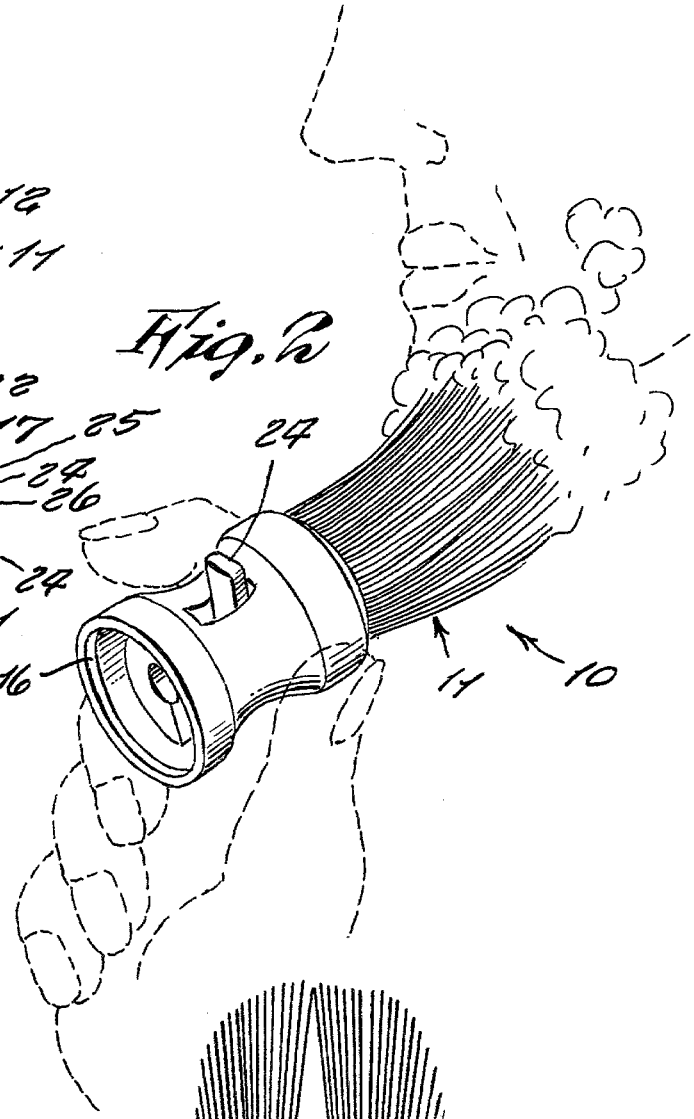
Figure 3:
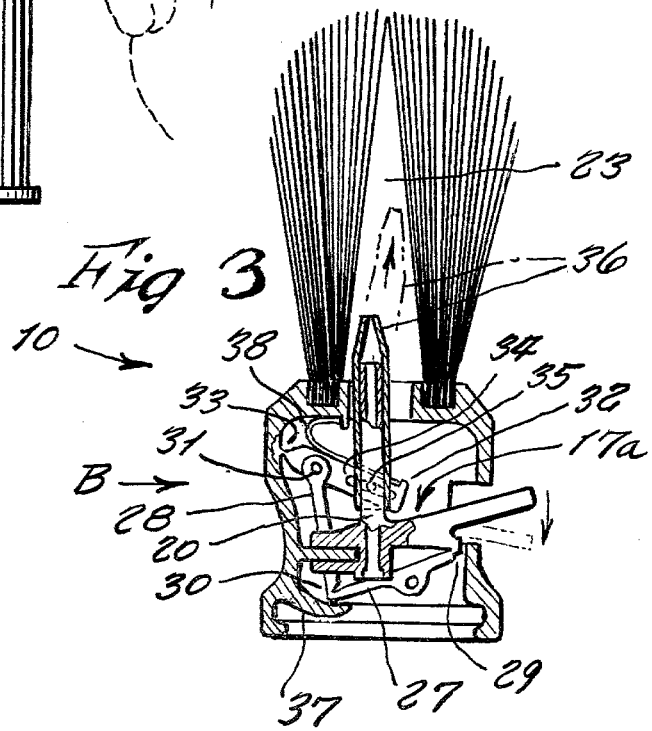

These, and other objects, will be readily evident, upon a study of the following specification, and the accompanying drawing, wherein:

FIG. 1 is a side cross-sectional view of the invention, mounted on an aerosol pressurized can of shaving cream;

FIG. 2 is a perspective view of the invention, shown in use lathering a beard, and FIG. 3 is a view similar to FIG. 1, and showing a modified design of the invention, in which the discharge tube is automatically upwardly raised, when the push button is downwardly depressed, so that the cream is discharged more into the outer end of the brush, instead of at its base, where it is more readily used; it being accomplished by a simple linkage molded into the two plastic parts, such as are used in FIG. 1, and requiring only one additional part, that consists of a simple leaf spring, that returns the device back to start position.

Referring now to the drawing in greater detail, the reference numeral 10 represents a shaving brush attachment, according to the present invention, wherein one design A thereof is shown in FIG. 1, and another design B thereof is shown in FIG. 3.

The design A comprises a brush bristle head 11, made of individual tufts of bristles 12, and which are imbedded in a hollow, molded, semi-hard plastic base 13, that snap-fits upon a replaceable aerosol can 14 of shaving cream, by means of the can bead 15, that fits into inside groove 16.

A spout extension 17, molded also of a semi-hard plastic, has a recess 18 for an inward tongue 19 of the base to fit therein. The tongue is thin, so that it is able to flex sufficiently for its intended purpose. The spout extension 17 also includes a tube 20, which, at one end, fits on the cannister spout 21, the tube protruding out of a wide hole 22 at the top of the base, so as to protrude into a central area 23, surrounded on all sides by the brush bristles 12. The tube end does not protrude very far into the area 23, in order that it does not scrape against a person's face, when the bristles are flexed during a lathering process. A lever 24, integral with the extension 17, protrudes outwardly of a large hole 25 on a side of the base, so that it may be manually depressed, as indicated by arrow 26, so that the tube depresses the cannister spout, and causes shaving cream to be dispensed into the area 23.

In use, it is now evident that after wetting the brush head in hot water, all that is needed is to depress the lever 24 for a moment, and then brush the bristles back and forth across the bearded face, so that lather forms thereupon.

In the modified design B, shown in FIG. 3, a tube extension additionally moves upwardly into area 23, during the time that the shaving cream is being dispensed.

This is accomplished by the extension 17*a*, molded of semi-hard plastic, additionally including a pair of links 27 and 28 molded therewith, and having thin portions 29 and 30 therebetween, so as to serve as hinges. The end of link 28 is pivotally attached on a protrusion 31, formed on a link 32, molded integrally with the semi-hard plastic base. A thin portion 33, at the connection of link 32, serves as a hinge. The link 32 has a slot 34, in which a protrusion 35, formed on the outer side of a tube extension 36, fits. The tube extension slides upward upon the tube 20, when the lever is depressed, causing link 27 to slide on a pad 37, so as to straighten link 28 more vertically and pivot the link 31, against action of return spring 38. Thus, the shaving cream is discharged to an upper part of the bristles, where it is most needed.

While various changes may be made in the detail construction, it is understood that such changes will be within the spirit and scope of the present invention, as is defined by the appended claims.

What I now claim is:

1. A shaving brush attachment for a canister of shaving cream, comprising, in combination, a hollow semi-hard plastic molded base, having, at its lower end, a groove receiving a head of said canister, a spout extension, fitted inside said base, being pivotable about a thin tongue formed on a side of said base, and an upward tube, integral with said extension, being fitted upon an upward spout of said canister, an upper end of said tube protruding upwardly out of said base and among brush bristles affixed upon said base; a sideward lever, formed on said extension, protruding out of a side of said base, for being manually depressed; and a tube extension slidable on said tube, a first link pivotally connected at one end to a longitudinally intermediate portion of said lever, an opposite end of said first link being pivotally connected to an end of a second link rested upon an inclined pad, so as to cause said second link to slide upwardly when said lever is downwardly depressed, an upper end of said second lever being pivotally connected to an intermediate portion of a third link pivotally connected, at one end, to a side of said base, an opposite end of said third link having a longitudinal slot engaging a protrusion formed of a side of said tube extension, so as to slide said tube extension upwardly, when said lever is depressed.

2. The combination as set forth in claim 1, wherein said third tube is downwardly inclined in its downward position, and said tube extension, at such time, is angularly tilted slightly toward one side direction, and said third tube, in a raising, horizontal position, tilts said tube extension slightly in an opposite direction, as said tube extension is upwardly raised among said bristles.

* * * * *